US008356495B2

(12) United States Patent
Lee et al.

(10) Patent No.: US 8,356,495 B2
(45) Date of Patent: Jan. 22, 2013

(54) LAUNDRY APPARATUS

(75) Inventors: Kyu Hwan Lee, Changwon-si (KR); Jung Chan Kim, Changwon-si (KR); Hee Tae Lim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 922 days.

(21) Appl. No.: 12/453,619

(22) Filed: May 15, 2009

(65) Prior Publication Data

US 2009/0293551 A1 Dec. 3, 2009

(30) Foreign Application Priority Data

May 16, 2008 (KR) ..... 10-2008-0045639
May 16, 2008 (KR) ..... 10-2008-0045643

(51) Int. Cl.
*B08B 3/12* (2006.01)
*D06F 37/00* (2006.01)

(52) U.S. Cl. ..... 68/3 R

(58) Field of Classification Search ..... None
See application file for complete search history.

(56) References Cited

U.S. PATENT DOCUMENTS 5,765,404 A * 6/1998 Fanson et al. ..... 68/23.2
5,906,056 A 5/1999 Noguchi et al.

FOREIGN PATENT DOCUMENTS

CN 2698829 5/2005
CN 1861892 11/2006
CN 1880557 A 12/2006

* cited by examiner

*Primary Examiner* — Michael Barr
*Assistant Examiner* — Jason Ko
(74) *Attorney, Agent, or Firm* — McKenna Long & Aldridge LLP

(57) ABSTRACT

A laundry apparatus is disclosed. A laundry apparatus includes a cabinet, a drum rotatable in the cabinet, a weight balancer compensating eccentric rotation of the drum, and a securing member inertedly securing the weight balancer to the drum.

18 Claims, 9 Drawing Sheets

LAUNDRY APPARATUS

CROSS REFERENCE TO RELATED APPLICATION

This application claims the benefit of the Korean Patent Application No. 10-2008-0045643, filed on May 16, 2008, and Korean Patent Application No. 10-2008-0045639, filed on May 16, 2008, which are hereby incorporated by reference as if fully set forth herein.

BACKGROUND OF THE DISCLOSURE

1. Field of the Disclosure

The present invention relates to a laundry apparatus. More particularly, the present invention relates to a laundry apparatus including a weight balancer.

2. Discussion of the Related Art

In general, laundry apparatuses are electric appliances that are used to clean laundry by washing or drying laundry. Such a laundry apparatus includes a drum receiving laundry and a driving part rotating the drum.

Once the driving part rotates the drum, the laundry loaded into the drum rotates according to the rotation of the drum.

Here, the laundry apparatus for washing laundry further includes a tub that the drum is rotatable within, receiving wash water, such that the laundry may be washed by friction force with the wash water.

The laundry apparatus for drying laundry supplies hot air to the drum during the rotation of the drum, such that the laundry may be dried.

Thus, the rotation of the drum is necessary in any type of laundry apparatus.

If the laundry is one-sided within the drum, a gravity center of the drum would not correspond to that of the driving part and this could cause eccentricity phenomenon.

If the drum is rotated with neglecting this eccentricity, vibration and noise would occur only to deteriorate durability of the laundry apparatus.

To solve this eccentric problem, a weight balancer may be provided which is secured to the drum by an auxiliary securing member.

However, even though the weight balancer is secured to the drum by the auxiliary securing member, the securing state between them would get loose because of the vibration generated during the rotation of the drum.

In case the securing between the drum and the weight balancer is loose, the eccentricity of the drum may get severe.

SUMMARY OF THE DISCLOSURE

Accordingly, the present invention is directed to a laundry apparatus including a weight balancer.

An object of the present invention is to provide a weight balancer provided in a laundry apparatus which can maintain secure connecting state with the drum in spite of vibration generated during the rotation of a drum.

Another object of the present invention is to provide a weight balancer provided in a laundry apparatus capable of being secured to the drum without any auxiliary securing members.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry apparatus includes a cabinet; a drum rotatable in the cabinet; a weight balancer compensating eccentric rotation of the drum; and a securing member insertedly securing the weight balancer to the drum.

The securing member may include a hook provided in an outer circumferential surface of the weight balancer; and a hooking hole provided in the drum, the hooking hole the hook is inserted in.

The drum may include a flange the weight balancer is inserted in; and a seating recess the weight balancer is seated in.

The securing member insertedly may secure the weight balancer to an inner circumferential surface of the flange.

The securing member may include a hook provided in an outer circumferential surface of the weight balancer; and a hooking hole provided in the flange, corresponding to the hook.

The hook may include a first hook and a second hook and the first and second hooks are spaced apart a predetermined distance from each other in parallel to a rotational shaft of the weight balancer.

A plurality of hooks may be provided along the outer circumferential surface of the weight balancer and the plurality of the hooks are symmetrical to each other with respect to a center of the weight balancer.

The securing member may include a hook including an extending portion extending along the outer circumferential surface of the weight balancer and a head portion provided in an end of the extending portion; and a protrusion portion provided in an inner circumferential surface of the flange corresponding to the hook, the protrusion portion securing the position of the hook.

The protrusion portion may be configured of elastic member to form a passage of the hook when the hook is insertedly to the drum.

The extending portion comprises a rib receiving the protrusion portion.

The securing member may secure the weight balancer to the flange, with the weight balancer inserted in the inner circumferential surface of the flange being rotated to a predetermined angle.

The securing member may include a pair of protrusions spaced apart a predetermined distance from each other along an outer circumferential surface of the weight balancer; and a pair of wings provided in the flange, the pair of the wings secured to space formed by the pair of the protrusions.

The pair of the wings may be elastic when being pressed by the pair of the protrusions, respectively.

A distance between ends of the wings may be substantially larger than a distance between the protrusions.

A rib may be provided in a side of each protrusion, the rib supporting each wing such that the weight balancer is prevented from separating.

The pair of the protrusions may be provided along the outer circumferential surface of the weight balancer in plural and the pairs of the protrusions may be symmetrical to each other with respect to a center of the weight balancer.

The securing member may include a securing hole provided in the seating recess and a securing part provided in the weight balancer, the securing part rotatable in a state of being inserted in the securing hole.

The securing part may include an extending portion extending from the weight balancer; and a head portion provided in an end of the extending portion, and a sectional size of the head portion is substantially larger than a sectional size of the extending portion.

The securing hole may include an inserting portion the head portion is inserted in; and a passage portion forming a rotation passage of the extending portion having the head portion inserted therein.

The securing member may include an elastic piece extending toward the passage portion, the elastic piece adjacent to the inserting portion; and a covering member preventing the securing member from being exposed to inner space of the drum.

The length of the extending portion may be corresponding to the thickness of the seating recess.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
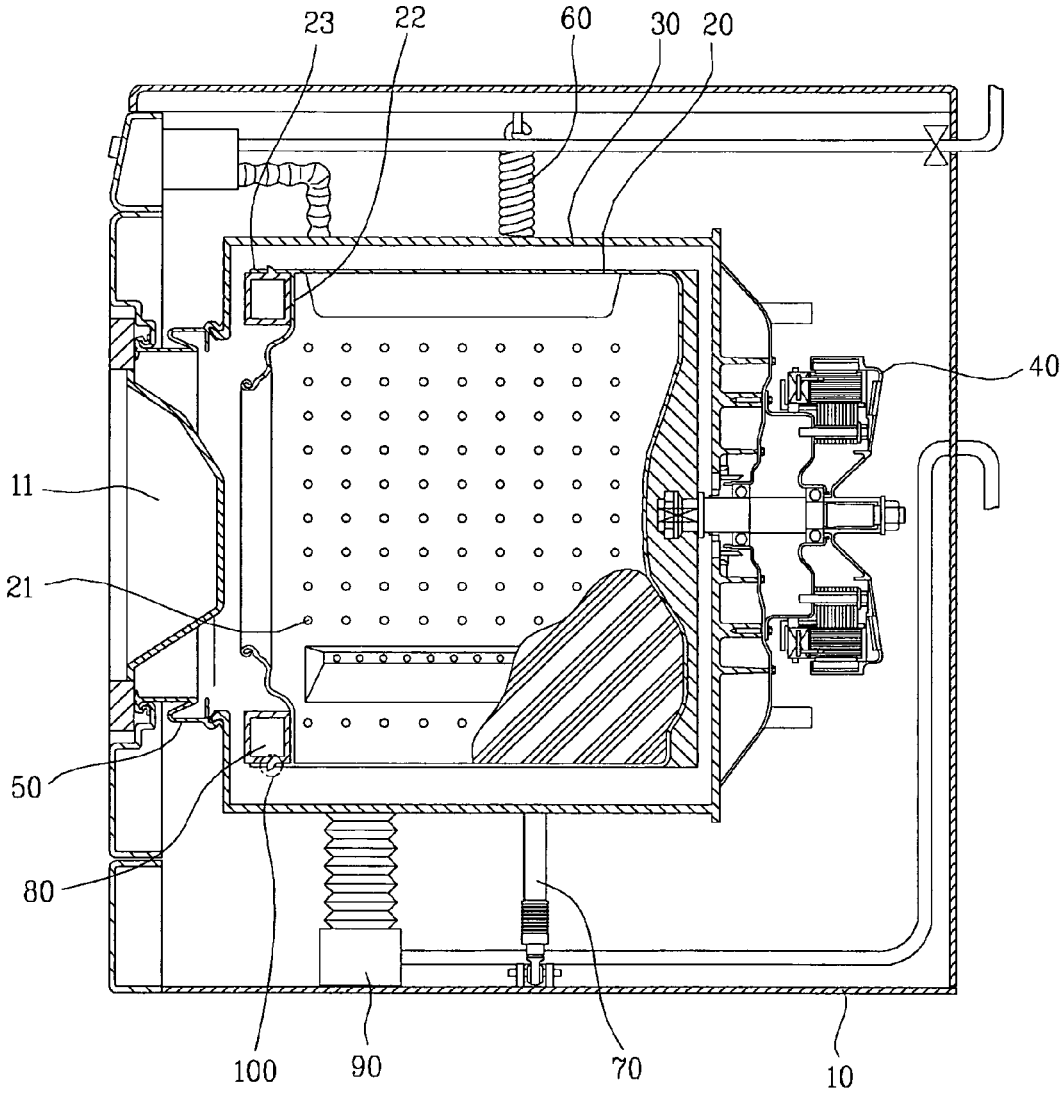
FIG. 1 is a sectional view illustrating an exterior appearance of a laundry apparatus according to a first exemplary embodiment of the present invention.

FIG. 1 is a sectional view illustrating an exterior appearance of a laundry apparatus according to a first exemplary embodiment of the present invention and an overall configuration of this embodiment will be described as follows.

A laundry apparatus according to the present invention includes a cabinet 10, a tub 30 and a drum 20. The cabinet 10 defines an exterior appearance of the laundry apparatus. The tub 30 is provided in the cabinet 10 and the oriented rotatable drum 20 is provided in the tub.

The tub 20 may be fixed to the cabinet 10 via a spring 60 and a damper 70. A driving part 40 may be provided in a rear of the tub 30.

The driving part 40 is connected to the drum 20, passing the tub 30 such that the driving part 40 may provide a rotational force with the drum 20.

A plurality of through holes 21 may be formed in a circumferential surface of the drum 20 and the through holes 21 pass wash water received in the tub 30 into the drum 20.

In addition, a door 11 may be coupled to a front of the drum 20 to load or unload the laundry into or from the drum 20.

To maintain airtight state between the tub and the door 11 may be provided a gasket 50 and in a bottom surface of the tub 30 may be provided a drain hole 90 to drain wash water inside the tub 30.

According to the laundry apparatus including the above components, laundry is loaded into the drum 20 via the door 11 and washing and drying operation performs while the driving part 40 rotates the drum.

If the drum is rotated with the laundry one-sided in a specific portion of an inner circumferential surface of the drum 20, not uniformly, the gravity center of the drum 20 may not correspond to the center of rotation, that is, eccentricity may occur.

Especially, in case of a drum-type laundry apparatus, a drum is horizontal with a bottom of the drum-type laundry apparatus. During the rotation of the drum, laundry is rotated in a state of adhering to one side of the drum surface by gravity and this may cause the eccentricity.

If such an eccentric rotation continues in that the drum is rotated with the gravity center of the drum 20 being eccentric from the rotation center, the drum 20 would have cause vibration, noise, deterioration of washing efficiency and overload on the driving part 40.

Because of that, this embodiment may include a weight balancer 80 to compensate the eccentric rotation of the drum.

The weight balancer 80 includes a housing defining inner space thereof and material having a predetermined weight (hereinafter, balancer). Here, the balancer may be movable along the housing.

While the housing is rotated together with the drum, the balancer is moving in a gravity direction inside the housing to compensate the gravity center of the drum 20 such that the eccentric rotation of the drum 20 may be prevented.

The balancer may be configured of liquid balancer or a ball balancer having a predetermined weight.

In reference to FIG. 2, a securing structure between the weight balancer 80 and the drum 20 will be described in detail as follows.

The weight balancer 80 may be secured to the drum 20 to compensate the eccentricity of the drum 20, rotating together with the drum 20.

If the weight balancer 80 is provided apart from the driving part 40, even a little motion of the balancer may generate a substantially large moment and thus it is advantageous to compensate the eccentricity of the drum 20.

As a result, it is preferable that the weight balancer 80 is secured to a front surface of the drum 20.

At this time, the balancer 80 is installed in the front of the drum only to improve eccentricity compensation and this embodiment may not exclude a case of a weight balancer 80 provided in a rear surface of the drum.

The laundry apparatus may include a configuration capable of insertedly securing the weight balancer 80 to the drum 20 such that an assembly process may be simple and that it may be prevented for a securing member, which is loose by the vibration generated during the rotation of the drum 20, to accelerate the eccentricity.

The weight balancer 80 may include a hook 110 and the drum may include a hooking hole 120 allowing the hook 110 inserted therein. That is, the hook 110 is inserted in the hooking hole 120 such that the weight balancer 80 may be insertedly secured to the front surface of the drum 20.

The drum 20 may further include a flange 23 and a seating recess 22 to make smooth the inserted securing of the weight balancer 80.

The flange 23 is formed in an extending portion of the outer circumferential front surface of the drum 20 and an outer circumferential surface of the weight balancer 80 contacts with the flange 23. The seating recess 22 is provided in the front surface of the drum 20 and a surface of the weight balancer 80 is seated in the seating recess 22.

In this case, the hooking hole 120 may pass through the flange 23.

As a result, the weight balancer 80 is inserted in the front surface of the drum along the flange 23 until its surface is seated in the seating recess 22. Here, once the hook 110 of the weight balancer 80 is inserted in the hooking hole 120, the weight balancer 80 may be securely fixed to the front of the drum 20.

Such the inserted securing of the weight balancer 80 to the drum 20 by using the hook 110 could prevent a disadvantage of the loose securing member and a disadvantage of the detached weight balancer 80.

Figure 3:
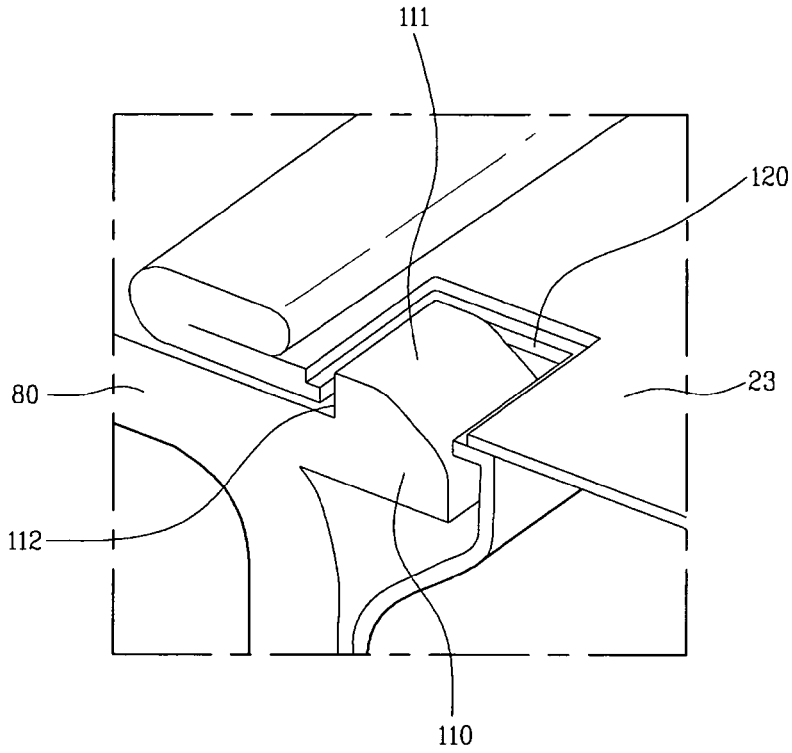
FIG. 3 is an enlarged view illustrating a securing portion between the drum and the weight balancer.

In reference to FIG. 3, the hook 110 and the hooking hole 120 will be described in detail as follows.

Figure 2:
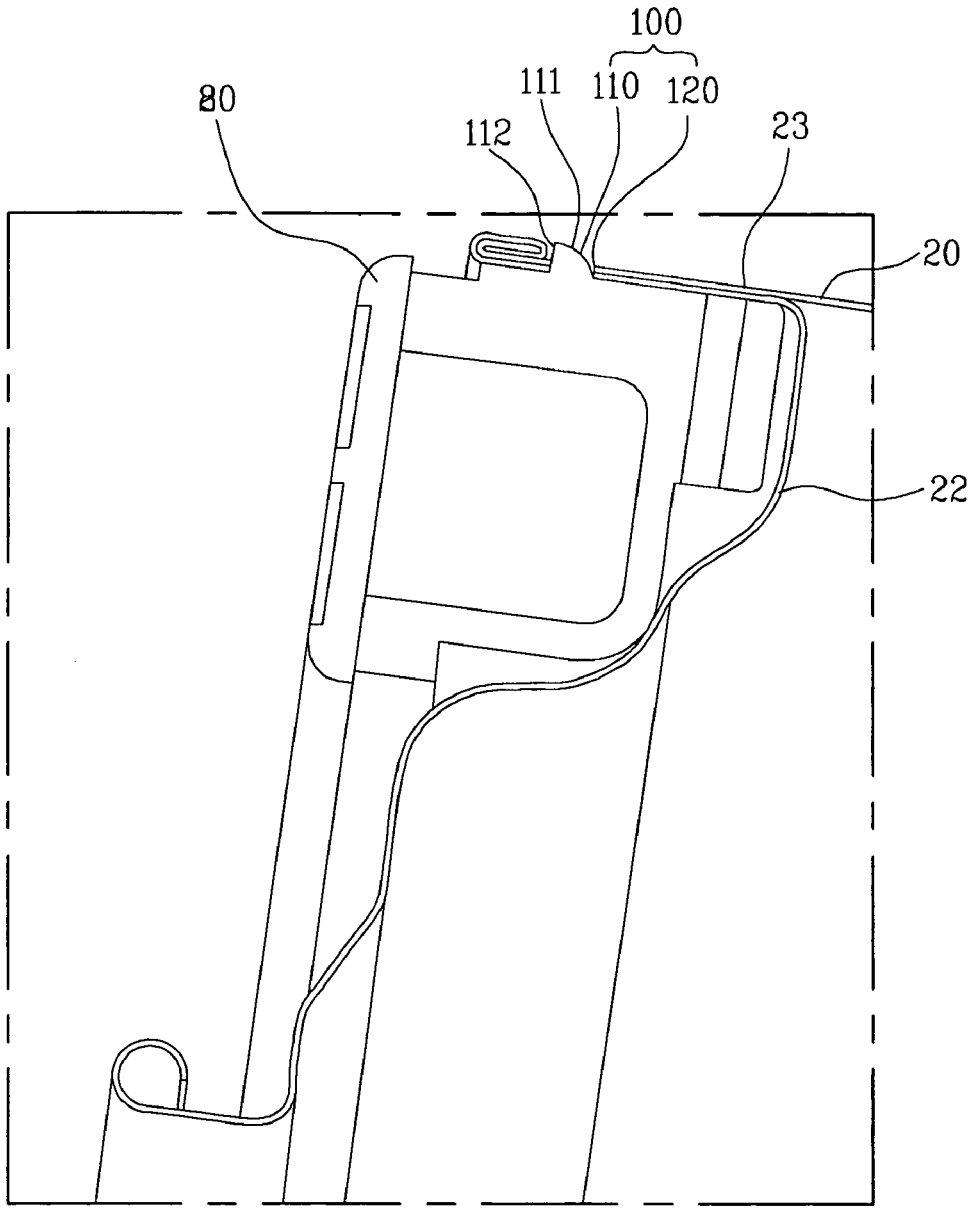
FIG. 2 is a sectional view illustrating securing between a drum and a weight balancer of the laundry apparatus according to the first exemplary embodiment of the present invention.

The hook 110 may be projected from the outer circumferential surface of the weight balancer 80 as shown in FIG. 2. Alternatively, the hook 110 may be projected from an extending portion which is extended a predetermined distance from the outer circumferential surface of the weight balancer 80 toward the drum 20 as shown in FIG. 3.

Here, the hook 110 may include an oblique side 111 such that the hook 110 may move into the seating recess 22, without being hooked to the flange 23, when the weight balancer 80 is inserted in the flange 23.

The hook 110 may further include a rear side 112 formed perpendicular to the outer circumferential surface of the weight balancer 80 such that the weight balancer 80 may be prevented from separating out when the hook 110 is inserted in the hooking hole 120.

The length of the hooking hole 120 is identical to the length of the hook 110 such that the rear side 112 of the hook 110 may not spaced apart from the hooking hole 120. Because of that, the motion range of the weight balancer 80 may be minimized as much as possible, in case the weight balancer 80 is insertedly secured to the front of the drum 20.

In the meanwhile, a plurality of hooks 110 may be provided in the weight balancer 80 and a plurality of hooking holes 120 may be provided in the flange 23, corresponding to the plurality of the hooks 110.

Here, it is preferable that the hooks 110 are positioned symmetrical each other with respect to the rotation center of the weight balancer 80. This may enable the weight balancer 80 to be secured smoothly.

If the hooks 110 are not symmetrical with respect to the rotation center of the weight balancer 80, the only position making each of the hooks 110 corresponding to each of the hooking hole 120 should be found to secure the weight balancer 80 to the drum 20.

However, if the hooks 110 and the hooking holes 120 are symmetrical with respect to the center of the weight balancer, one of the hooks 110 is positioned in corresponding one of the hooking holes 120 such that the other hooks 110 are positioned precisely in the corresponding hooking holes 120 automatically. As a result, the securing of the weight balancer 80 to the drum may be performed securely.

Figure 4:
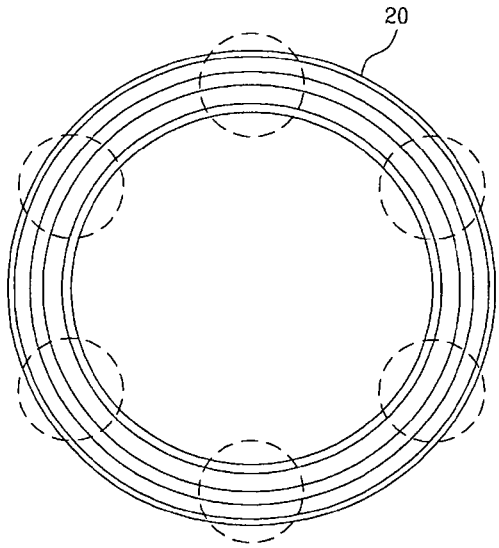
FIG. 4 is a diagram illustrating a position where a securing member is provided.

For example, the hooks 110 are provided along the circumference of the weight balancer 80 in an interval at an interval of 60 degrees and the hooking holes 120 may be provided along the outer circumferential surface of the flange 23 at an interval of 60 degrees, too (see FIG. 4).

Figure 5:
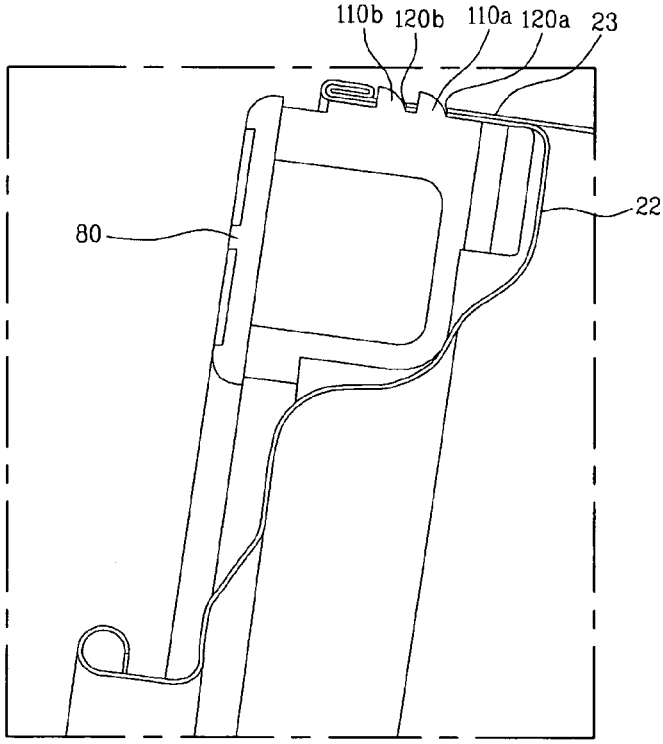
FIG. 5 is a sectional view illustrating securing between a drum and a weight balancer of a laundry apparatus according to a second embodiment of the present invention.

In reference to FIG. 5, a second embodiment of the present invention will be described as follows. Here, the identical configuration to the above first embodiment will be omitted.

According to this embodiment, the weight balancer 80 includes a double hook 110*a* and 110*b*. The flange 23 includes a first hooking hole 120*a* and a second hooking hole 120*b* the hooks are inserted in, respectively.

That is, the weight balancer 80 may include a plurality of double hooks provided along its circumference in an interval of 60 degrees and the double hook may include a first hook 110*a* and a second hook 110*b* spaced apart a predetermined distance from the first hook 110*a*.

The flange 23 may include the first hooking hole corresponding to the first hook 110*a* and the second hooking hole 120*b* corresponding to the second hook 110*b*.

The appearance of the first and second hooks 110*a* and 110*b* and the appearance of the first and second hooking holes 120*a* and 120*b* may be identical to those of the hook and the hooking hole mentioned in the above embodiment. This embodiment enables the weight balancer 80 to be double-secured to flange 23 of the drum 20.

Once the weight balancer 80 is pressed in the front of the flange 23, the first hook 110*a* is inserted in the second hooking hole 120*b* primarily. Once the weight balancer 80 is pressed further, the first hook 110*a* is insertedly secured to the first hooking hole 120*a* and the second hook 110*b* is insertedly secured to the second hooking hole 120*b* secondarily.

At this time, to make the primary and secondary securing performed sequentially, it is preferable that the appearance of the first and second hook 110*a* and 110*b* and the appearance of the first and second hooking hole 120*a* and 120*b* are identical.

According to this embodiment, the weight balancer 80 is inserted in the flange 23 doubly to be secured to the drum 20. As a result, the securing efficiency of the weight balancer 80 may be enhanced and danger of weight balancer separation can be minimized.

Although this embodiment presents two hooks 110*a* and 110*b* and corresponding two hooking holes 120*a* and 120*b*, more than two hooks and more than two hooking holes may be applicable to the present invention.

In reference to FIGS. 6 and 7, a third embodiment of the present invention will be described as follows. Similar or identical configuration to the first and second embodiments will be omitted.

Figure 6:
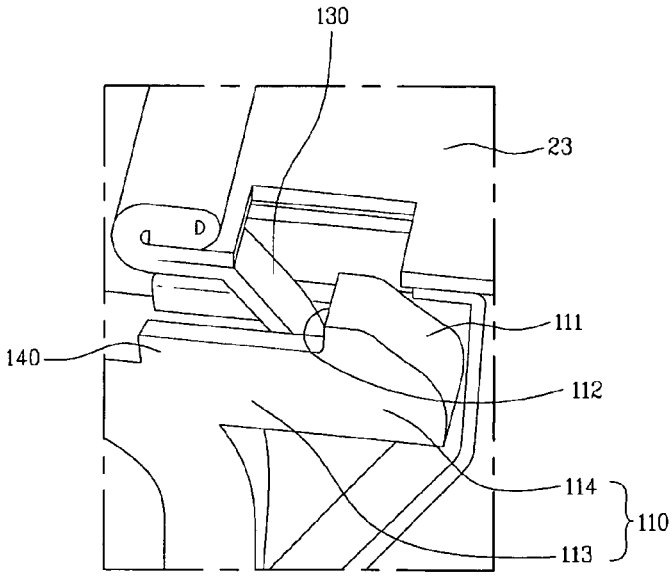
FIG. 6 is a diagram illustrating securing between a drum and a weight balancer of a laundry apparatus according to a third embodiment of the present invention.

FIG. 6 is a sectional view illustrating a portion where a weight of a laundry apparatus according to a third embodiment is secured.

To secure the weight balancer 80 to the drum 20, the above first and second embodiments present that at least one hook 110 is inserted in the corresponding hooking hole 120 formed in the flange 23 of the drum 20.

In contrast, this embodiment presents a protrusion 130 provided in the flange 23 to prevent the separation of the weight balancer 80.

Specifically, the hook 110 may include an extending portion 113 extending toward a rear direction of the outer circumferential surface of the weight balancer 80 and a head portion 114 formed at an end of the extending portion 113.

Here, the flange 23 may include a protrusion 130 projected along its inner circumferential surface toward a center of the drum 20.

Once the weight balancer 80 is inserted in the seating recess 22 along the flange 23, the protrusion 130 is positioned to support a rear of the head portion 114 such that the weight balancer 80 may be prevented from separating from the drum 20.

Here, it is preferable that the protrusion 130 has elasticity to be pulled back upward (seen from the drawing) when the head portion 114 is inserted and to return to its original position after the head portion 114 passes therein.

Above first and second embodiments present that the hook 110 is inserted in the hooking hole 120 formed in the flange 23, some portion of the hook may be exposed out of the drum.

Because of that, the tub holding the drum therein should be spaced apart a predetermined distance from the drum.

However, if the size of the hook 110 is reduced to minimize the space between the drum and the tub, the weight balancer 80 happens to separate from the drum because of the vibration of the drum.

According to this embodiment, to remove that danger, the protrusion 130 provided in the flange 23 supports the head portion 114 to fix the weight balancer 80 securely.

As a result, this embodiment requires no space for the hook between the drum 20 and the tub 30 advantageously.

The head portion 114 of the hook 110 according to this embodiment may include the oblique side, which is identical to that of above embodiment, to make the weight balancer 80 inserted smoothly.

The head portion 114 may include a perpendicular rear side such that the separation of the weight balancer 80 may be prevented by the protrusion. Alternatively, the rear side may be oblique toward the head portion 114.

The protrusion 130 may include an oblique side having the same oblique direction as the head portion 114.

After a predetermined portion of the flange 23 is lanced along a circumferential direction, the protrusion 130 is sloped from the lanced portion toward the center of the drum 20 such that a process of manufacturing the protrusion 130 may be compact.

Figure 7:
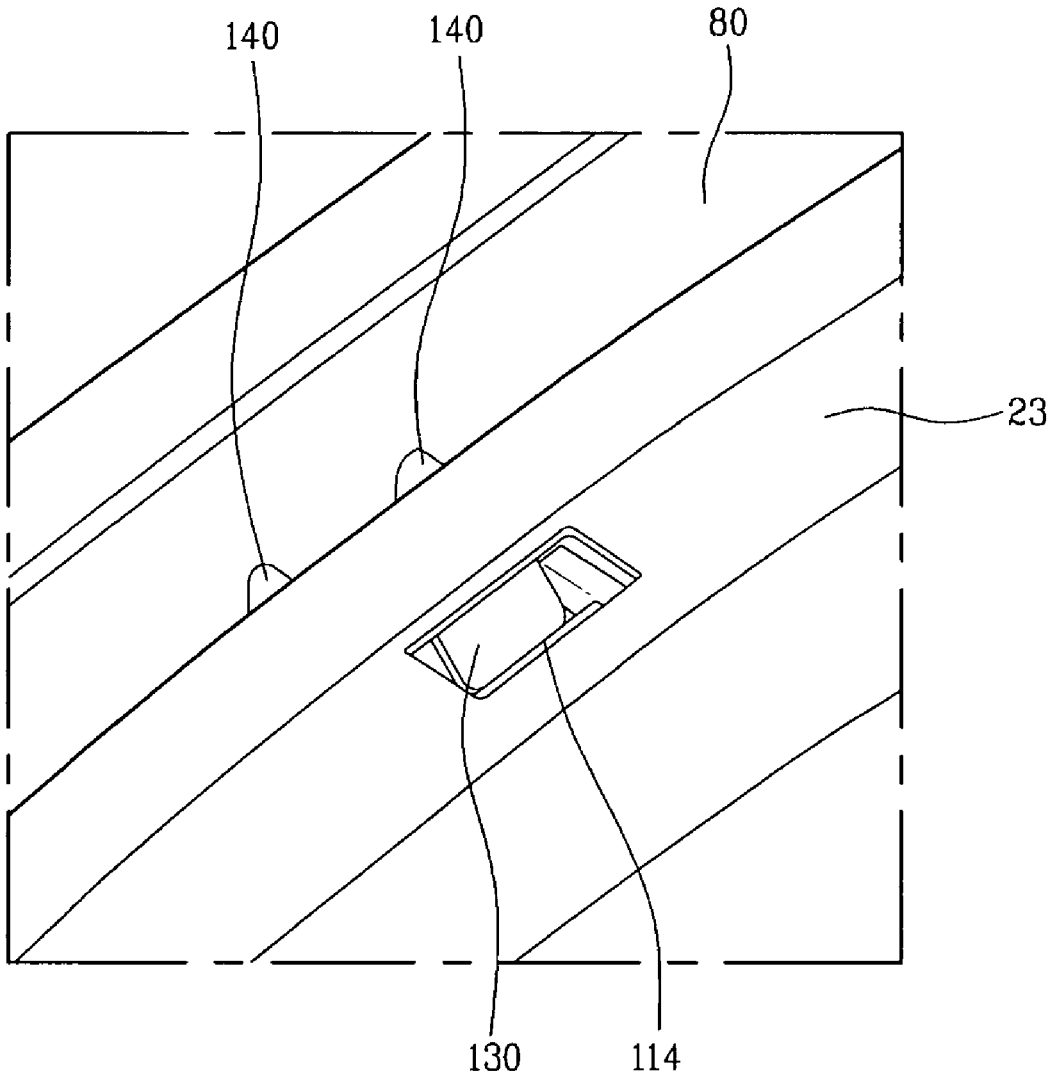
FIG. 7 is a perspective view illustrating a state of the weight balancer shown in FIG. 6 being secured to the drum.

FIG. 7 is diagram illustrating that the weight balancer 80 of FIG. 6 is secured to the drum 20.

Once the hook 110 is secured to the protrusion 130, the weight balancer 80 is supported by the protrusion 130 only not to separate in its insertion direction. However, the weight balancer 80 happens to separate in the rotation direction of the drum 20.

Because of that, the hook 110 may further include at least one rib 140 formed in the extending portion 113 to prevent from separating from the protrusion 130 by the rotation of the drum 20.

Here, the ribs 140 formed in the extending portion may be spaced apart from each other as far as the width of the protrusion 130.

When the protrusion 130 supports the rear side of the hook 110, the protrusion 130 is inserted in the space defined by the ribs 140 such that the protrusion 130 may separate from the head portion 114 when the drum 20 is rotated.

As a result, the weight balancer 80 may be prevented from separating from the drum 20 even during the rotation of the drum 20.

In addition to the hook 110, the hooking hole and the rib mentioned above, the weight balancer 80 may be secured to the drum 20 by a securing member such as a screw.

That is, after secured to the drum 20 by the hook 110 primarily, the weight balancer 80 may be secured to the drum 20 by the securing member secondarily. This configuration has an advantage of smooth simple securing of the securing member and an advantage of strong weight balancer separation prevention, compared with a case of securing the weight balancer to the drum by only using the securing member.

Figure 8:
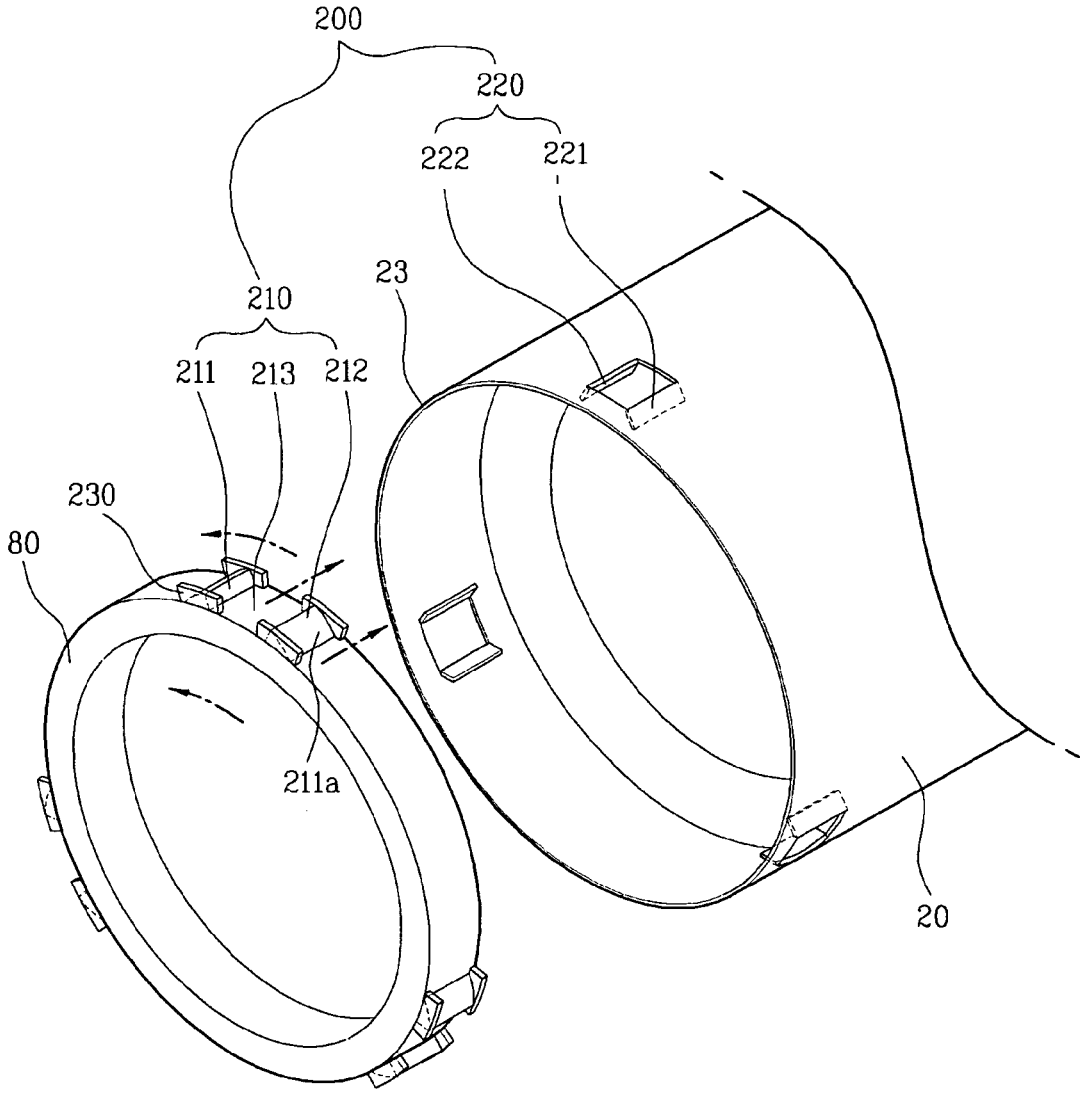
FIG. 8 is an exploded perspective view illustrating a drum and a weight balancer provided in a laundry apparatus according to a fourth embodiment of the present invention.

FIG. 8 is an exploded perspective view illustrating a drum 20 and a weight balancer 80 of a laundry apparatus according to a fourth embodiment.

This embodiment has the same configuration as the first to third embodiments, in that the weight balancer 80 is secured to the flange 23, except that the weight balancer 80 is secured to the flange 23 by a protrusion portion 210 and a wing portion 220 not by the hook or hooking hole.

In reference to FIG. 8, this fourth embodiment will be described and the identical configuration to the first to third embodiments will be omitted.

After insertedly secured to the flange 23, the weight balancer 80 is rotated and secured to the drum 20.

To embody the above effect, a securing member 200 is provided in the weight balancer 80 and the drum 20 to secure the weight balancer 80 to the drum 20.

The securing member 200 may include a protrusion portion 210 provided in an outer circumferential surface of the weight balancer 80 and a wing portion 220 provided in the flange 23 of the drum 20.

The wing portion 220 provided in the flange 23 may include at least one pair of wings 221 and 222 projected toward the rotation center of the drum 20.

The wing portion 220 is made of elastic member, having both opposite ends, that is, wings being bent toward opposite directions, respectively, not facing each other.

The protrusion portion 210 may include at least one pair of protrusions 211 and 212 projected from an outer circumferential surface of the weight balancer 80, respectively.

The pair of the protrusions 211 and 212 are spaced apart a predetermined distance from each other and the distance may be identical or narrower to or than the distance between both ends of the wings.

In reference to FIG. 9, the securing process between the weight balancer 80 and the drum 20 by using the protrusion portion 210 and the wing portion 220 will be described. Here, for the convenience sake, the distance between the pair of the protrusions 211 and 212 will be referenced to as 'recess' 213.

The weight balancer 80 is inserted in the flange 23 provided in the drum 20. Here, the wing is positioned in the recess 213.

Figure 9:
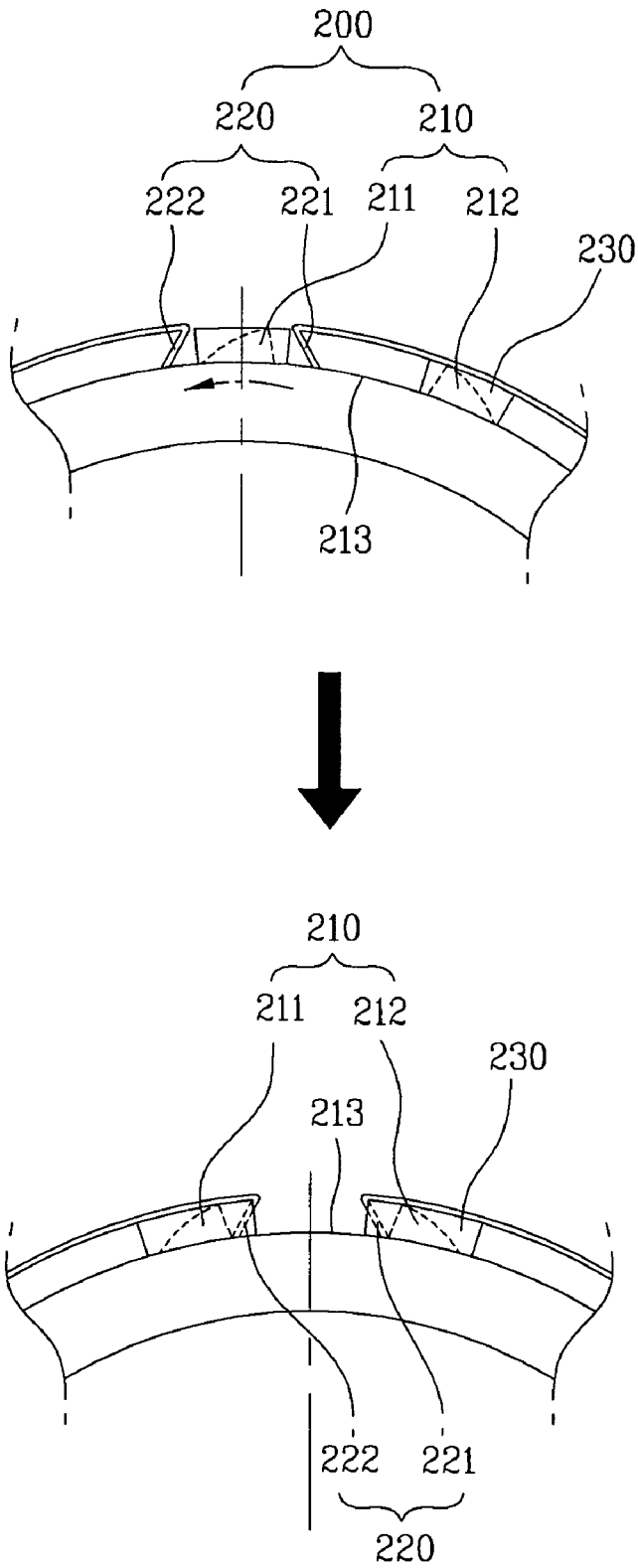
FIG. 9 is a conceptual view illustrating a process of securing the weight balancer to the drum shown in FIG. 8.

Once the wing 221 is inserted in the recess 213, the weight balancer 80 may be rotated in an arrow direction shown in FIG. 9.

Hence, the protrusion 211 is rotated together with the weight balancer, pressing the wing 222. When pressed by the protrusion 211, the wing 222 is elastic-transformed to supply a path the protrusion 211 can be rotated along.

As the weight balancer 80 is rotated continuously, the elastic-transformed wing 222 is out of the press performed by the protrusion 211 and it is inserted in the recess 213 again by restitution of elasticity.

As mentioned above, it is preferable that the width of the recess is identical to or narrower than the distance between the wings 221 and 222.

If the width of the recess 213 is larger than the distance between the wings, the weight balancer 80 might be rotated along an inner circumferential surface of the flange 23 during the rotation of the drum 20.

However, if the width of the recess 213 is identical to or smaller than the distance between the wings, the weight balancer 80 may be secured by the elastic restitution in that the wings are spread in both opposite directions. As a result, the weight balancer 80 could not be rotated along the inner circumferential surface of the flange 23 during the rotation of the drum 20.

The pair of the wings 221 and 222 inserted in the recess of the protrusion portion 210 may support the pair of the protrusions 211 and 212 such that the weight balancer 80 may be secured to the drum 20.

Each protrusion 211 and 212 of the protrusion portion 210 may include an oblique side 211*a* to press the wings 221 and 222 smoothly.

That is, it is preferable that the height of each protrusion 211 and 212 is increasing toward the recess 213.

According to above securing process, the wing 221 is inserted in the recess 213. Alternatively, after the other wing 222 of the pair is inserted in the recess 213, the weight balancer 80 would be rotated.

In this case, the weight balancer 80 should be rotated in an opposite direction to the arrow shown in FIG. 9 to be secured to the drum 20. Here, the securing process is identical to the above process and detailed description thereof will be omitted.

Figure 10:
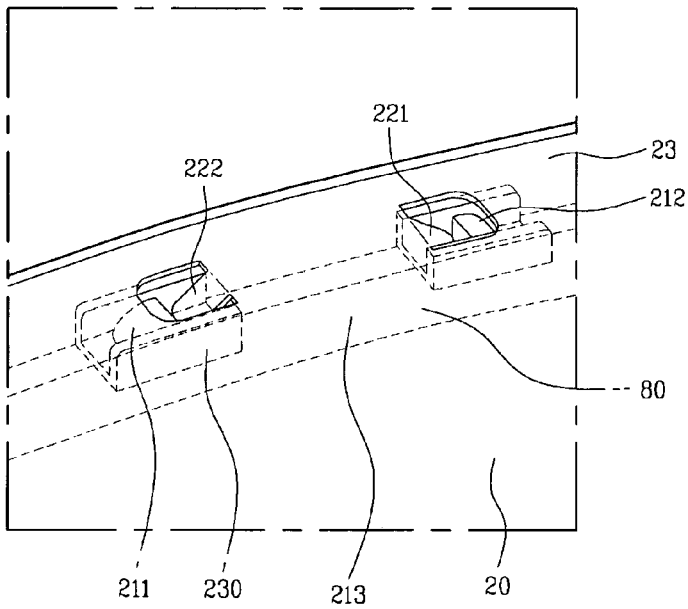
FIG. 10 is a diagram illustrating a drum and a weight balancer of a laundry apparatus according to a fifth embodiment of the present invention.

FIG. 10 illustrates a weight balancer 80 secured to the flange 23 according to a fifth embodiment, seen from above the flange 23.

According to this embodiment, in case the weight balancer 80 is secured to the flange 23, the weight balancer 80 may be prevented from separating in a front direction of the drum 20.

The protrusions 211 and 212 according to this embodiment may include ribs 230 provided along a circumference of the weight balancer 80, respectively.

The rib 230 is formed in both sides of each protrusion 211 and 213 and it extends to the recess 213 to receive the wing 221 and 222.

A plurality of protrusion portions 210 may be provided in the weight balancer 80 and the protrusion portions 210 are symmetrical to each other with respect to the center of the weight balancer 80.

Only if one of the protrusion portions 210 is corresponding to one of the wing portions 220, the weight balancer 80 may be secured to the drum 20 effectively.

In reference to FIG. 11, a sixth embodiment of the present invention will be described.

Figure 11:
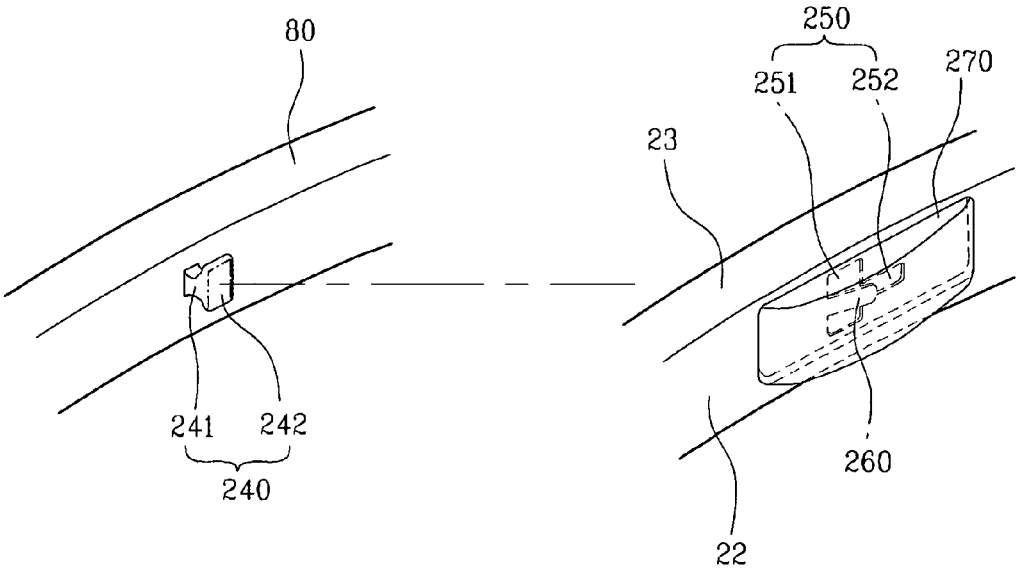
FIG. 11 is an exploded perspective view illustrating a drum and a weight balancer of a laundry apparatus according to a sixth embodiment of the present invention.

FIG. 11 is a perspective view illustrating a rear surface of a weight balancer 80 and a seating recess 22 of a drum 20 where the weight balancer 80 is seated.

According to this embodiment, the weight balancer 80 is secured to the seating recess 22 formed in the front of the drum 20, not in the inner circumferential surface of the flange 23. A securing member for securing the weight balancer to the drum 20 may be configured of a securing part 230 and a securing hole 250.

The weight balancer 80 which will be seated in the seating recess 22 includes a plurality of securing parts 240 formed in a rear surface thereof.

The securing part 240 includes an extending portion 241 extending from the rear surface of the weight balancer 80 and a head portion 242 provided in an end of the extending portion 241.

The seating recess 22 may includes a plurality of securing holes 250 the securing parts 240 are inserted and rotated in.

The securing hole 250 may include an inserting portion 250 where the head portion 242 is inserted and a passage portion 252 extending from the inserting portion 251 in a circumference direction of the drum 20.

The inserting portion 251 is larger than the head portion 242 such that the head portion 242 may be inserted in the inserting portion 251.

Once the weight balancer 80 is seated in the seating recess 22, the securing part 240 passes the seating recess 22 via the inserting portion 251.

The passage portion 252 has appearance corresponding to a sectional appearance of the extending portion 241.

As a result, after seated in the seating recess 22, the weight balancer 80 may be rotated along the passage portion 252.

Here, the head portion 242 has a larger sectional appearance than the extending portion 241 to prevent the weight balancer 80 from separating out of the seating recess forwardly after rotated along the passage portion 252.

As shown in FIG. 11, the seating recess 22 may further include an elastic piece 260 securing the position of the securing part 240 after moving along the passage portion 252.

An end of the elastic piece 260 extends from the end of the inserting portion 251, where the passage portion 252 is formed, toward the passage portion 252.

In addition, the elastic piece 260 may have elasticity enough to be transformed toward a direction in which it is pressed once the head portion 242 is inserted in the inserting portion 251.

The elastic piece 260 may have the length or structure enough to release the press of the head portion 241 having moved to the end of the passage portion 252.

Figure 12:
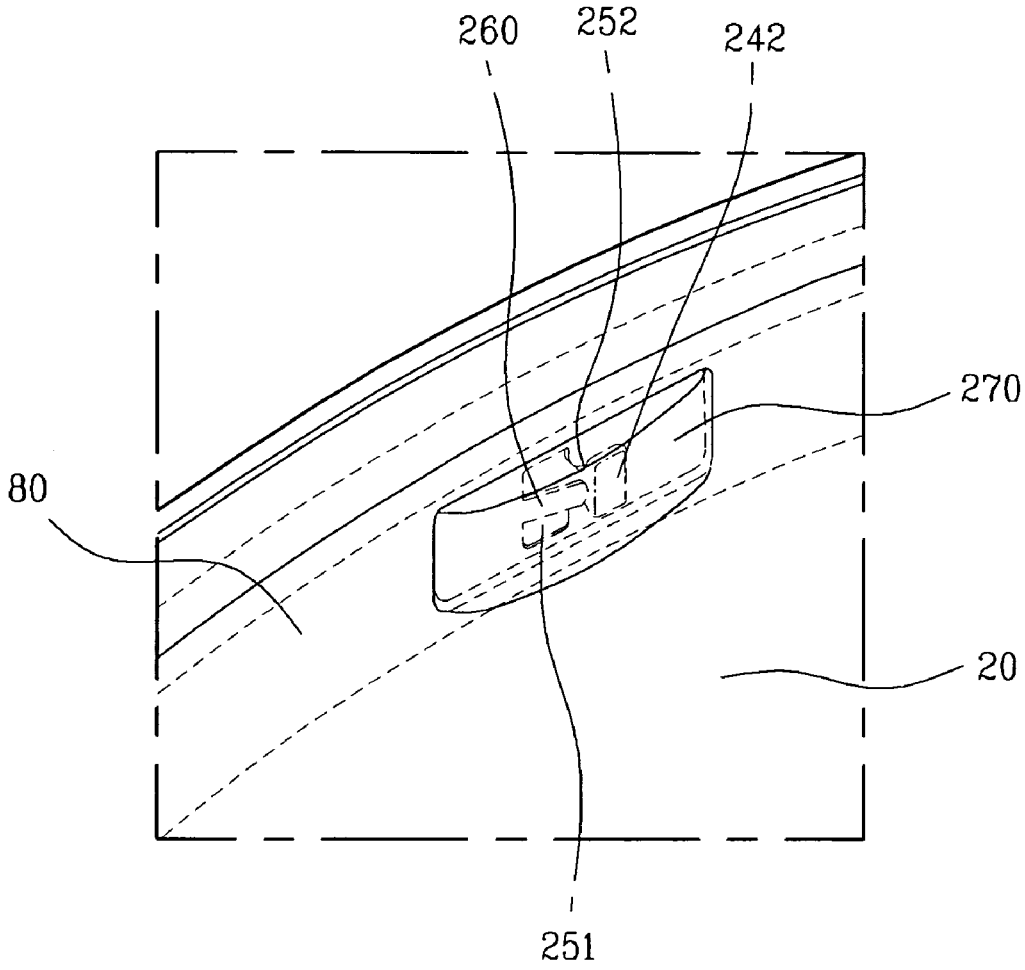
FIG. 12 is a diagram illustrating securing between the drum and the weight balancer shown in FIG. 11.

FIG. 12 is a diagram illustrating that the weight balancer 80 shown in FIG. 11 is seated in the seating recess 22.

Once the securing part 240 moves along the passage portion 252 completely, the elastic piece 260 is restituted to support a predetermined portion of the securing part 240 such that the position of the weight balancer 80 may be secured.

The securing part 240 may have various structures for the elastic member 260 to support.

That is, the head portion 242 and the extending portion 241 may be stepped and it is preferable that the head portion 242 and the extending portion 241 are plane in parallel.

As a result, the elastic piece 260 supports a side of the securing part 240 right after being released from the press of the head portion 242 and it prevents the weight balancer 80 secured to the drum 20 from being rotated in the seating recess 22 simultaneously.

In the meanwhile, a covering member 270 may be further provided in a rear surface of the seating recess 22 to prevent both of the elastic piece 260 and the head portion 242 from being exposed to inner space of the drum 20 in a state of the weight balancer 80 being secured to the drum 20.

The rear surface of the seating recess 22 may correspond to an inner surface of the drum 20 and thus the covering member 270 may prevent the laundry loaded in the drum 20 from damaged by the elastic piece 260 and the head portion 242.

Here, it is preferable that the covering member 270 is spaced apart a predetermined distance to a rear direction of the inserting portion 252 and the passage portion 252 such that the securing part 240 can be inserted and rotated.

The securing process between the weight balancer 80 and the drum 20 will be described as follows.

First of all, the head portion 242 of the securing part 240 is inserted in the inserting portion 252 of the securing hole 250.

Hence, the weight balancer 80 is seated in the seating recess 22 and the elastic piece 260 is elastically pressed by the head portion 242 such that the passage the securing part 240 is rotated along may be secured.

Hence, the weight balancer 80 is rotated along the passage portion 152. Once the weight balancer 80 is rotated completely to be positioned in the end of the passage portion 252, the extending portion 241 of the securing part 240 is in close contact with the end of the passage portion 252.

At this time, the elastic piece 260 is released from the press of the head portion 242 and it supports the securing part 240 because of its restitution such that the weight balancer 80 may be secured to the drum 20 completely.

Here, to prevent the weight balancer 80 from being moved in a forward and rearward direction of the drum 20 by the rotation and vibration of the drum 20, the extending portion 241 may be extended as long as the depth of the securing hole 250, that is, the thickness of the seating recess 22.

As a result, the weight balancer 80 is prevented from moving in a state of being seated in the seating recess 22 of the drum 20.

A plurality of above securing parts 240 may be provided in a rear surface of the weight balancer 80 and the securing parts may be positioned symmetrically each other with respect to the center of the weight balancer 80. Because of that, if only one of the securing parts is corresponding to one of the securing holes 250, the weight balancer 80 may be secured to the drum 20 smoothly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry apparatus comprising:

a cabinet;

a drum rotatable in the cabinet;

a weight balancer compensating eccentric rotation of the drum; and a securing member insertedly securing the weight balancer to the drum, wherein the securing member comprises:

a hook having an extending portion extending along an outer circumferential surface of the weight balancer and a head portion provided in an end of the extending portion;

a hooking hole provided in the drum to receive the head portion;

a protrusion portion provided in an inner circumferential surface of the drum to support the head portion for securing the position of the hook; and two ribs provided in the extending portion along the length direction of the extending portion, wherein the two ribs are spaced apart from each other as far as a width of the protrusion portion and the protrusion portion is inserted in a space defined by the two ribs when the weight balancer is secured to the drum.

2. The laundry apparatus of claim 1, wherein the drum comprises, a flange the weight balancer is inserted in; and a seating recess the weight balancer is seated in.

3. The laundry apparatus of claim 2, wherein the securing member insertedly secures the weight balancer to an inner circumferential surface of the flange.

4. The laundry apparatus of claim 3, wherein the securing member comprises, a hook provided in an outer circumferential surface of the weight balancer which is adjacent to the flange; and a hooking hole provided in the flange, the hooking hole corresponding to the hook.

5. The laundry apparatus of claim 4, wherein the hook comprises a first hook and a second hook and the first and second hooks are spaced apart a predetermined distance from each other in parallel to a rotational shaft of the weight balancer.

6. The laundry apparatus of claim 5, wherein a plurality of hooks are provided along the outer circumferential surface of the weight balancer and the plurality of the hooks are symmetrical to each other with respect to a center of the weight balancer.

7. The laundry apparatus of claim 1, wherein the protrusion portion is configured of elastic member to be pulled back upward when the head portion is inserted and to return to its original position after the head portion passes the protrusion portion.

8. The laundry apparatus of claim 2, wherein the securing member secures the weight balancer to the flange, with the weight balancer inserted in the inner circumferential surface of the flange being rotated to a predetermined angle.

9. The laundry apparatus of claim 8, wherein the securing member comprises, a pair of protrusions spaced apart a predetermined distance from each other along an outer circumferential surface of the weight balancer; and a pair of wings provided in the flange, the pair of the wings secured to space formed by the pair of the protrusions.

10. The laundry apparatus of claim 9, wherein the pair of the wings are elastic when being pressed by the pair of the protrusions, respectively.

11. The laundry apparatus of claim 10, wherein a distance between ends of the wings is substantially larger than a distance between the protrusions.

12. The laundry apparatus of claim 10, further comprising a rib provided in a side of each protrusion, the rib supporting each wing such that the weight balancer is prevented from separating.

13. The laundry apparatus of claim 9, wherein the pair of the protrusions is provided along the outer circumferential surface of the weight balancer in plural and the pairs of the protrusions are symmetrical to each other with respect to a center of the weight balancer.

14. The laundry apparatus of claim 8, wherein the securing member comprises, a securing hole provided in the seating recess and a securing part provided in the weight balancer, the securing part rotatable in a state of being inserted in the securing hole.

15. The laundry apparatus of claim 14, wherein the securing part comprises, an extending portion extending from the weight balancer; and a head portion provided in an end of the extending portion, and a sectional size of the head portion is substantially larger than a sectional size of the extending portion.

16. The laundry apparatus of claim 15, wherein the securing hole comprises, an inserting portion the head portion is inserted in; and a passage portion forming a rotation passage of the extending portion having the head portion inserted therein.

17. The laundry apparatus of claim 16, wherein the securing member comprises, an elastic piece extending toward the passage portion, the elastic piece adjacent to the inserting portion; and a covering member preventing the securing member from being exposed to inner space of the drum.

18. The laundry apparatus of claim 17, wherein the length of the extending portion is corresponding to the thickness of the seating recess.

* * * * *